United States Patent [19]

Jones

[11] 4,007,716

[45] Feb. 15, 1977

[54] OFFSET VALVE LIFTER EFFECTING VALVE ROTATION

[75] Inventor: Kenneth R. Jones, Thiensville, Wis.

[73] Assignee: Allis-Chalmers Corporation, Milwaukee, Wis.

[22] Filed: Aug. 22, 1975

[21] Appl. No.: 606,923

[52] U.S. Cl. ..... 123/90.28; 74/569; 123/90.2; 123/90.48

[51] Int. Cl.[2] ..... F01L 1/32

[58] Field of Search ..... 123/90.2, 90.48, 90.28, 123/90.29, 90.3, 90.21; 74/569, 55

[56] References Cited

UNITED STATES PATENTS

| | | | |
|---|---|---|---|
| 1,129,555 | 2/1915 | Curran | 123/90.28 |
| 1,623,826 | 4/1927 | Burleson | 123/90.28 |
| 1,707,244 | 4/1929 | Williams | 123/90.28 |
| 1,927,020 | 9/1933 | Brown | 123/90.28 |
| 3,574,304 | 4/1971 | Santi | 123/90.28 |

*Primary Examiner*—C. J. Husar
*Assistant Examiner*—Daniel J. O'Connor
*Attorney, Agent, or Firm*—Robert C. Sullivan

[57] ABSTRACT

An arrangement for rotating a valve of a reciprocating internal combustion engine relative to the valve seat in addition to the normal reciprocating motion of the valve, whereby to more evenly distribute wear on the valve and on the valve seat, and, in the case of an exhaust valve, to more uniformly distribute heating of the valve and thus avoid or minimize thermal distortion of the exhaust valve. The rotation of the valve is obtained by use of the well known principle in accordance with which the central longitudinal axis of the valve lifter is offset from the central plane (as measured in the lengthwise dimension of the cam shaft) of the rotating cam which imparts reciprocatory movement to the valve lifter and thus to the valve. The offset relation just described imparts a rotary movement to the valve lifter which, in turn, imparts a rotary movement to the valve during the period of cam rotation when the valve is lifted off the valve seat. In applicant's construction, two aligned bores preferably of equal diameter are provided in the cylinder block or engine body, the two bores lying on a common axis X-X with each other and with the central plane of the cam which actuates the valve lifter. The first or upper bore in the cylinder block receives a guide bushing having a valve-stem-receiving bore which is concentric and coaxial with the internal diameter of its corresponding cylinder block bore and thus lies on the axis X-X. The second or lower bore in the cylinder block receives a second guide bushing having a valve-lifter-stem-receiving bore lying on an axis Y-Y which is eccentric relative to internal diameter of its corresponding cylinder block bore. Thus the valve lifter whose stem is received by the bore of the second guide bushing lies on an axis Y-Y which is eccentric relative to the axis X-X which passes through the central plane of the cam. This eccentric relation of the axis of the valve lifter relative to the central plane of the cam causes rotation of the cam to impart a rotary motion to the valve lifter, which, in turn, imparts a rotary movement to the valve during the period when the valve is off the valve seat. Applicant's construction has the advantage that the two aligned preferably equal diameter bores in the cylinder block or engine body can be made by relatively simple and inexpensive machining operations, with the eccentric relation of the valve lifter to the cam being provided by a guide bushing having an eccentric bore therein, thereby eliminating the need for drilling an eccentric bore in the cylinder block for receiving the stem of the valve lifter.

22 Claims, 2 Drawing Figures

OFFSET VALVE LIFTER EFFECTING VALVE ROTATION

BACKGROUND OF THE INVENTION

1. Field of the Invention

This invention relates to valves for internal combustion engines together with means for effecting rotation of such valves to improve the operating life of both the valve and of the valve seat, and to prevent or minimize thermal distortion of the valve in the case of an exhaust valve.

2. Description of the Prior Art

It has been known in the prior art that it is desirable to provide means for rotating the poppet valve of an internal combustion engine about the longitudinal axis of the valve stem in addition to imparting the normal reciprocatory movement to the valve by means of the operating cam, since such rotation of the valve provides for more uniformly distributed wear of the valve head portion and also of the valve seat with which the head portion of the valve cooperates. In the case of an exhaust valve, rotation of the valve effects more uniform heat distribution throughout the valve head and valve stem and thus avoids or minimizes thermal distortion of the valve. Rotation of a poppet valve of an internal combustion engine or the like may be accomplished by providing a construction in which the valve lifter which is engaged by the rotating cam member has its central longitudinal axis offset from the central plane (with respect to the lengthwise dimension of the cam shaft) of the cam which engages the valve lifter. This offset relation of the longitudinal axis of the valve lifter relative to the cam which engages the valve lifter causes the rotating cam to effect a rotation of the valve lifter about its longitudinal axis and thus to effect a rotation of the valve engaged by the valve lifter during the period of cam rotation when the valve is lifted off the valve seat. The cooperation between the cam and the valve lifter of course additionally imparts a reciprocatory movement to the valve lifter and to the valve engaged by the valve lifter. Constructions of the general type just described are shown, for example, by U.S. Pat. Nos. 1,129,555 issued to Stanley Curran on Feb. 23, 1915; 1,470,102 issued to Fred Rahm on Oct. 9, 1923; 1,983,744 issued to Herman Dock on Dec. 11, 1934; and 2,925,808 issued to Karl Bauman on Feb. 23, 1960. Other United States patents related to the problem of providing valve rotation for internal combustion engines include the following: 3,056,394 issued to Ib H. Svendsen on Oct. 2, 1962; and 3,574,304 issued to John D. Santi on Apr. 13, 1971.

STATEMENT OF THE INVENTION

Accordingly, it is an object of the invention to provide an improved construction for effecting rotation of a valve relative to its valve seat in an internal combustion engine or the like.

It is a further object of the invention to provide an improved construction for effecting rotation of a valve relative to its valve seat in an internal combustion engine which operates upon the well-known principle of having the central longitudinal axis of the valve lifter offset from the central plane (with respect to the lengthwise dimension of the cam shaft) of the cam which engages the valve lifter, but which construction permits the use of axially aligned bores in the cylinder block or engine body to receive appropriately bored guide members for the valve stem and for the stem of the valve lifter.

It is another object of the invention to provide an arrangement for imparting rotation to a valve relative to a valve seat in an internal combustion engine or the like which operates upon the well known principle of having the longitudinal axis of the valve lifter offset relative to the central plane of the cam which engages the valve lifter whereby to obtain rotation of the valve relative to the valve seat, but in which such relationships may be obtained by relatively simple and inexpensive manufacturing techniques and with the use of relatively simple and inexpensive machining operations.

SUMMARY OF THE INVENTION

In achievement of these objectives, there is provided in accordance with an embodiment of the invention an arrangement for rotating a valve of a reciprocating internal combustion engine relative to the valve seat in addition to the normal reciprocating motion of the valve, whereby to more evenly distribute wear on the valve and on the valve seat, and, in the case of an exhaust valve, to more uniformly distribute heating of the valve and thus avoid or minimize thermal distortion of the exhaust valve. The rotation of the valve is obtained by use of a well-known principle in accordance with which the central longitudinal axis of the valve lifter is offset from the central plane (as measured in the lengthwise dimension of the cam shaft) of the rotating cam which imparts reciprocatory movement to the valve lifter and thus to the valve. The offset relation just described imparts a rotary movement to the valve lifter which, in turn, imparts a rotary movement to the valve during the period of cam rotation when the valve is lifted off the valve seat. In applicant's construction, two aligned bores of preferably equal diameter are provided in the cylinder block, the two bores lying on a common axis X-X with each other and with the central plane of the cam which actuates the valve lifter. The first or upper bore in the cylinder block receives a guide bushing having a valve-stem-receiving bore which is concentric and coaxial with the internal diameter of its corresponding cylinder block bore and thus lies on the axis X-X. The second or lower bore in the cylinder block receives a second guide bushing having a valve-lifter-stem-receiving bore lying on an axis Y-Y which is eccentric relative to internal diameter of its corresponding cylinder block bore. Thus, the valve lifter whose stem is received by the bore of the second guide bushing lies on an axis which is eccentric relative to the axis X-X which passes through the central plane of the cam. This eccentric relation of the axis of the valve lifter relative to the central plane of the cam causes rotation of the cam to impart a rotary motion to the valve lifter, which, in turn, imparts a rotary movement to the valve during the period when the valve is off the valve seat. Applicant's construction has the advantage that the two aligned preferably equal diameter bores in the cylinder block can be made by relatively simple and inexpensive machining operations, with the eccentric relation of the valve lifter to the cam being provided by a guide bushing having an eccentric bore therein, thereby eliminating the need for drilling an eccentric bore in the cylinder block or engine body for receiving the stem of the valve lifter.

BRIEF DESCRIPTION OF THE DRAWING

Further objects and advantages of the invention will become apparent from the following description taken in conjunction with the accompanying drawing in which.

DESCRIPTION OF THE PREFERRED EMBODIMENT

Figure 2:
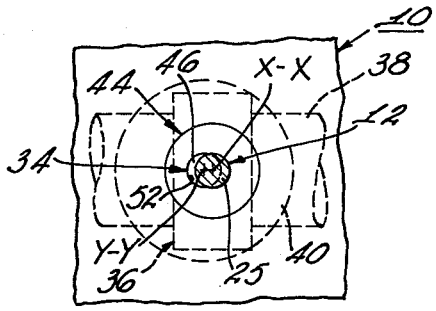
FIG. 2 is a view taken along line II—II of FIG. 1.
Figure 1:
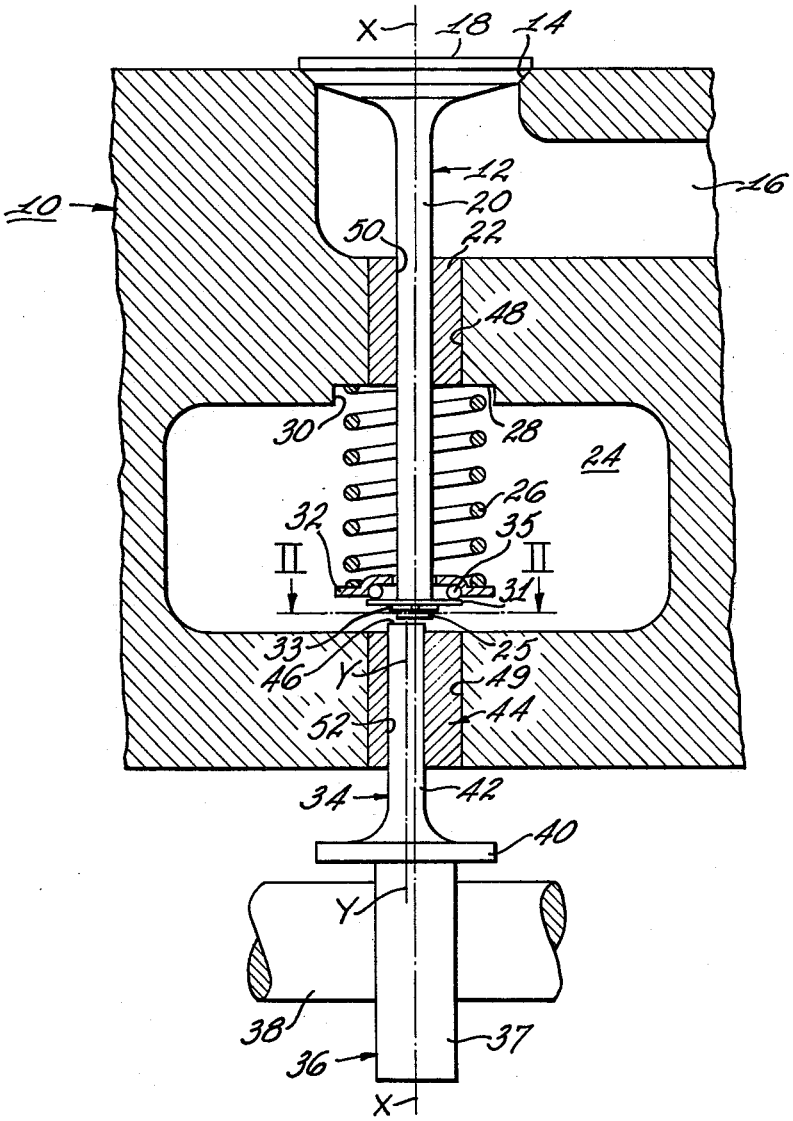
FIG. 1 is a view in vertical section of a portion of an internal combustion engine showing the relation of the valve, the valve lifter, the rotatable cam and the guide bushings in the cylinder block bores relative to each other.

Referring now to the drawing, and more particularly to FIG. 1, there is shown a cylinder block or engine body generally indicated at 10, of a reciprocating internal combustion engine. Cylinder block 10 typically is made of a material such as cast iron or aluminum. The engine may be a single cylinder or multiple cylinder engine. A poppet valve generally indicated at 12 and which may be either an inlet valve or an exhaust valve controls the flow of gases through a valve seat 14 which forms the mouth of a gas passage 16 in cylinder block 10. Normally it is more important that an exhaust valve be rotated than that an inlet valve be rotated. Valve 12 includes a valve head 18 which is adapted to seat on valve seat 14 and a valve stem 20. Valve stem 20 passes downwardly through gas passage 16, thence downwardly through a bore in guide bushing 22 to be described more fully hereinafter, and emerges from the lower end of guide bushing 22 relative to the view shown in FIG. 1 into a hollow spring chamber 24 which is formed in cylinder block 10. A helical spring 26 is coaxially positioned about the portion of valve stem 20 which extends into spring chamber 24. The upper end of spring 26 relative to the view shown in FIG. 1 bears against the upper bounding surface 28 of a countersunk recess 30 formed in cylinder block 10. The lower end of spring 26 bears against a keeper or spring seat 32 of larger diameter than the outer diameter of spring 26. The radially inner portion of keeper 32 has a clearance permitting rotation of valve stem 20 relative to keeper 32. The radially inner portion of keeper 32 is contoured to define a race for ball bearings 35 which roll upon the upper surface of a washer 31. Washer 31 is preferably press-fitted on and rotates with valve stem 20. The ball thrust bearing assembly comprising keeper 32, balls 35, and washer 31 is retained at a fixed position contiguous the lower portion of valve stem 20 by means of a snap ring 33 or other suitable fastening means mounted in a groove on valve stem 20 contiguous the lower end of the valve stem. Helical spring 26 reacts against keeper 32 to constantly tend to move valve head 18 to the closed position in which it is seated on valve seat 14 as seen in FIG. 1. During the rotation of valve 12, to be hereinafter described, spring 26 and keeper 32 remain non-rotating and the ball thrust bearing minimizes frictional forces caused by spring 26 which would otherwise tend to restrain rotation of valve 12.

A valve lifter generally indicated at 34 cooperates with a cam generally indicated at 36 which is fixed to and rotates with a horizontal rotatably mounted cam shaft 38. Valve lifter 34 includes a foot portion 40 which, due to the force of gravity, continuously rides on the surface of rotating cam 36. Valve lifter 34 also includes an integral lifter stem 42 which extends upwardly, relative to the view of FIG. 1, through an eccentric bore in guide bushing 44, as will be explained more fully hereinafter.

The lengths of valve stem 20 and of valve lifter stem 42 are so dimensioned that when valve 12 is seated, as shown in FIG. 1, the facing ends of valve stem 20 and of valve lifter stem 42 are spaced from each other, so that in the closed position of valve 12 the continuous rotation of valve lifter 34 imparted by rotation of cam 36, as will be described, is ineffective to cause rotation of valve 12.

In accordance with an important feature of the construction, cylinder block 10 is provided with two axially aligned and preferably equal internal diameter bores 48 and 49 which respectively lie above and below spring chamber 24 on a common axis X—X. The central plane of cam 36 on cam shaft 38 (i.e., the plane lying at the midpoint of the longitudinal dimension of cam 36 as measured along cam shaft 38) also lies on the same common axis X—X as the bores 48 and 49. Guide bushings 22 and 44 which respectively receive valve stem 20 and lifter stem 42 of valve lifter 34 are respectively press fitted into the respective bores 48 and 49.

Guide bushing 22 is provided with an axial bore 50 therethrough which lies along the axis X—X and thus is concentric with the outer diameter of guide bushing 22 and with the inner diameter of bore 48 in the cylinder block which receives guide bushing 22.

Guide bushing 44 is provided with a bore 52 therethrough to receive stem 42 of valve lifter 34. Bore 52 in guide bushing 44 is concentric about an axis Y—Y which is eccentric relative to the outer diameter of guide bushing 44 and consequently is eccentric relative to the inner diameter of bore 49 in cylinder block 10 which receives guide bushing 44. The axis Y—Y along which the valve lifter stem 42 is reciprocably movable under the influence of cam 36 is therefore eccentric or offset relative to the axis X—X which coincides with the midpoint of or central plane of cam 36 in its dimension longitudinally of cam shaft 38. Since the central longitudinal axis of valve 12 and of stem 20 of valve 12 also lie along the line X—X, it also follows that the central longitudinal axis Y—Y of valve lifter stem 42 is offset from the axis X—X of valve stem 20.

Guide bushing 22 which receives and guides valve stem 20 preferably is made of the same material as valve 12, typically hardened steel or a suitable bronze material, in order that the material of guide bushing 22 and of valve 12 be compatible with each other relative to thermal expansion and contraction characteristics. The surface of the internal diameter of bore 50 in guide bushing 22 should be hardened to a greater extent than the surface of the outer diameter of valve stem 20 which moves in bore 50. The outer diameter of valve stem 20 and the inner diameter of bore 50 in guide bushing 22 should be so dimensioned relative to each other as to provide a close sliding fit of valve stem 20 in bore 50 to minimize any leakage of gas at the interface between valve stem 20 and bore 50.

Guide bushing 44 which receives stem 42 of valve lifter 34 may also be made of the same material as valve lifter 34, such as hardened steel or a suitable bronze material. However, since valve lifter 34 and guide bushing 44 are located in a much lower temperature region than valve 12 and guide bushing 22 the problem of compatibility of the temperature expansion and contraction characteristics of the material of guide bushing 44 relative to the material of valve lifter 34 is not nearly as critical in the case of guide bushing 44 as in the case of guide bushing 22.

In the operation of the apparatus shown in the drawing, valve 12 is constantly biased by spring 26 toward a closed position as shown in FIG. 1 in which valve head 18 seats on valve seat 14. Once in each cycle of rotation of cam 36, the lobe 37 on cam 36 will move valve lifter 34 in an upward direction relative to the view shown in FIG. 1 to move the upper end 46 (relative to FIG. 1) of valve lifter stem 42 into engagement with the lower end 25 of valve stem 20 to raise valve stem 20 and thereby to raise valve head 18 off valve seat 14 and maintain it in such raised position for a predetermined dwell period. Further rotation of cam shaft 38 will cause cam lobe 37 to return to the position shown in FIG. 1 in which valve head 18 returns to its seated position relative to valve seat 14.

The rotation of cam 36 not only imparts a reciprocatory movement to valve lifter 34 to cause the opening and closing of valve head 18 relative to valve seat 14 as just described, but, in addition, the offset relation of central longitudinal axis Y—Y of stem 42 of valve lifter 34 relative to axis X—X which defines the midplane in the longitudinal dimension of cam 36 causes the rotation of cam 36 to also impart a continuous rotary movement to valve lifter 34 in accordance with which stem 42 of valve lifter 34 continuously rotates about its central longitudinal axis Y—Y.

Since the lower end 25 of valve stem 20 and the upper end 46 of valve lifter stem 42 are in frictional engagement with each other during the portion of the cycle in which head portion 18 of valve 12 is raised off of valve seat 14, it follows that the rotation of valve lifter stem 42 about its axis Y—Y will also impart a rotary movement to valve 12 about its central longitudinal axis X—X for the part of the cycle of rotation of cam 36 during which valve head 18 is raised above valve seat 14. Thus, for each rotation of cam 36, valve 12 and valve head 18 will also be rotated through at least a fraction of a complete revolution. Thus, on a plurality of rotations of cam 36, valve head 18 will be incrementally moved in the same circular direction about its axis of rotation X—X so that the position of valve head 18 relative to valve seat 14 is changed on each cycle of rotation of cam 36, thereby more evenly distributing the wear on valve head 18 and also on valve seat 14. Where valve 12 is an exhaust valve, the rotation of the valve will provide more uniform heating of the valve and will thus prevent or minimize thermal distortion of the valve.

The preferred construction hereinbefore described has the advantage that it provides a valve rotating arrangement which can be accomplished by simple and inexpensive machining operations. Thus, the bores 48 and 49 in the cylinder block 10 which respectively receive the guide bushings 22 and 44 are in axial alignment with each other and are also preferably, although not necessarily, of the same inner diameter. This permits the two equal diameter bores 48 and 49 in cylinder block 10 to be made by the same drilling tool approaching from the same direction (i.e., — the drilling tool approaches from above the cylinder block 10) with the bores 48 and 49 being made in succession by the same diameter drilling tool approaching in the same direction. Once the axially aligned and equal diameter bores 48 and 49 have been drilled in the cylinder block or engine body, the offset relation of the longitudinal axis of valve lifter 34 relative to cam 36 is achieved by inserting the guide bushing 44 having an eccentric bore 52 therein for receiving stem 42 of valve lifter 34, rather than requiring the drilling of an eccentric bore in the cylinder block or engine body.

Furthermore, the use of guide bushings 22 and 44 for valve stem 20 and for valve lifter stem 42, respectively, permits easy replacement of the guide bushings when they become worn.

From the foregoing detailed description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. In combination, a cylinder block for a reciprocating internal combustion engine, a fluid passage in said cylinder block, said fluid passage terminating in an opening bounded by a valve seat, a reciprocably movable valve movable relative to said valve seat from a closed position in which said opening of said fluid passage is closed to an open position in which said opening of said fluid passage is open, spring means normally biasing said valve to a closed position, said valve comprising a head portion adapted to seat on said valve seat and a stem portion, a first bore in said cylinder block, a first guide bushing in said first bore, a valve stem guide bore in said first bushing concentric with the inner diameter of said first bushing, a second bore in said cylinder block lying on a common axis with and in axial alignment with said first bore, a second guide bushing in said second bore, a valve lifter including a valve lifter stem adapted to engage and move said valve to open position, a rotatable cam mounted on a cam shaft and adapted to engage said valve lifter during the cycle of rotation of said cam whereby to cause said valve lifter to move said valve to open position, the central plane of said cam as measured in the lengthwise dimension of the cam shaft on which said cam is mounted lying on said common axis of said first and said second bores in said cylinder block, a bore in said second guide bushing for receiving and guiding the movement of said valve lifter stem, said bore in said second guide bushing being eccentric relative to said common axis, whereby rotation of said cam imparts rotation to valve lifter, said valve lifter being engageable with said stem portion of said valve during the cycle of rotation of said cam whereby to impart rotation to said valve relative to said valve seat.

2. The combination defined in claim 1 in which said first and said second bores in said cylinder block are of equal diameter.

3. The combination defined in claim 1 in which said valve lifter includes a foot portion which rides on the surface of said cam continuously during the rotation of said cam, said valve lifter stem being carried by and extending from said foot portion.

4. The combination defined in claim 1 in which said valve lifter engages said valve stem to impart rotation to said valve substantially only during the portion of the cycle of rotation of said cam in which said head portion of said valve is not seated on said valve seat.

5. The combination defined in claim 1 in which said cylinder block is provided with a hollow spring chamber, said first and said second bores in said cylinder block communicating with said spring chamber, said spring means being positioned in said spring chamber.

6. In combination, an engine body for a reciprocating internal combustion engine, a fluid passage in said engine body, said fluid passage terminating in an opening bounded by a valve seat, a reciprocably movable valve movable relative to said valve seat from a closed position in which said opening of said fluid passage is closed to an open position in which said opening of said fluid passage is open, spring means normally biasing said valve to a closed position, said valve comprising a head portion adapted to seat on said valve seat and a stem portion, a first bore in said engine body, a first guide bushing in said first bore, a valve stem guide bore in said first bushing concentric with the inner diameter of said first bushing, a second bore in said engine body lying on a common axis with and in axial alignment with said first bore, a second guide bushing in said second bore, a valve lifter including a valve lifter stem adapted to engage and move said valve to open position, a rotatable cam mounted on a cam shaft and adapted to engage said valve lifter during the cycle of rotation of said cam whereby to cause said valve lifter to move said valve to open position, the central plane of said cam as measured in the lengthwise dimension of the cam shaft on which said cam is mounted lying on said common axis of said first and said second bores in said engine body, a bore in said second guide bushing for receiving and guiding the movement of said valve lifter stem, said bore in said second guide bushing being eccentric relative to said common axis, whereby rotation of said cam imparts rotation to valve lifter, said valve lifter being engageable with said stem portion of said valve during the cycle of rotation of said cam whereby to impart rotation to said valve relative to said valve seat.

7. The combination defined in claim 6 in which said first and said second bores in said engine body are of equal diameter.

8. The combination defined in claim 6 in which said valve lifter includes a foot portion which rides on the surface of said cam continuously during the rotation of said cam, said valve lifter stem being carried by and extending from said foot portion.

9. The combination defined in claim 6 in which said valve lifter engages said valve stem to impart rotation to said valve substantially only during the portion of the cycle of rotation of said cam in which said head portion of said valve is not seated on said valve seat.

10. The combination defined in claim 6 in which said engine body is provided with a hollow spring chamber, said first and said second bores in said engine body communicating with said spring chamber, said spring means being positioned in said spring chamber.

11. In combination, a cylinder block for a reciprocating internal combustion engine, a fluid passage in said cylinder block, said fluid passage terminating in an opening bounded by a valve seat, a reciprocably movable valve movable relative to said valve seat from a closed position in which said opening of said fluid passage is closed to an open position in which said opening of said fluid passage is open, spring means normally biasing said valve to a closed position, said valve comprising a head portion adapted to seat on said valve seat and a stem portion, a first bore in said cylinder block, said first bore being adapted to guide said valve stem, a second bore in said cylinder block lying on a common axis with and in axial alignment with said first bore, a guide bushing in said second bore, a valve lifter including a valve lifter stem adapted to engage and move said valve to open position, a rotatable cam mounted on a cam shaft and adapted to engage said valve lifter during the cycle of rotation of said cam whereby to cause said valve lifter to move said valve to open position, the central plane of said cam as measured in the lengthwise dimension of the cam shaft on which said cam is mounted lying on said common axis of said first and said second bores in said cylinder block, a bore in said guide bushing for receiving and guiding the movement of said valve lifter stem, said bore in said guide bushing being eccentric relative to said common axis, whereby rotation of said cam imparts rotation to said valve lifter, said valve lifter being engageable with said stem portion of said valve during the cycle of rotation of said cam whereby to impart rotation to said valve relative to said valve seat.

12. The combination defined in claim 11 in which said valve lifter includes a foot portion which rides on the surface of said cam continuously during the rotation of said cam, said valve lifter stem being carried by and extending from said foot portion.

13. The combination defined in claim 11 in which said valve lifter engages said valve stem to impart rotation to said valve substantially only during the portion of the cycle of rotation of said cam in which said head portion of said valve is not seated on said valve seat.

14. The combination defined in claim 11 in which said cylinder block is provided with a hollow spring chamber, said first and said second bores in said cylinder block communicating with said spring chamber, said spring means being positioned in said spring chamber.

15. In combination, an engine body for a reciprocating internal combustion engine, a fluid passage in said engine body, said fluid passage terminating in an opening bounded by a valve seat, a reciprocably movable valve movable relative to said valve seat from a closed position in which said opening of said fluid passage is closed to an open position in which said opening of said fluid passage is open, spring means normally biasing said valve to a closed position, said valve comprising a head portion adpated to seat on said valve seat and a stem portion, a first bore in said engine body, said first bore being adapted to guide said valve stem, a second bore in said engine body lying on a common axis with and in axial alignment with said first bore, a guide bushing in said second bore, a valve lifter including a valve lifter stem adapted to engage and move said valve to open position, a rotatable cam mounted on a cam shaft and adapted to engage said valve lifter during the cycle of rotation of said cam whereby to cause said valve lifter to move said valve to open position, the central plane of said cam as measured in the lengthwise dimension of the cam shaft on which said cam is mounted lying on said common axis of said first and said second bores in said engine body, a bore in said guide bushing for receiving and guiding the movement of said valve lifter stem, said bore in said guide bushing being eccentric relative to said common axis, whereby rotation of said cam imparts rotation to valve lifter, said valve lifter being engageable with said stem portion of said valve during the cycle of rotation of said cam whereby to impart rotation to said valve relative to said valve seat.

16. The combination defined in claim 15 in which said valve lifter includes a foot portion which rides on the surface of said cam continuously during the rotation of said cam, said valve lifter stem being carried by and extending from said foot portion.

17. The combination defined in claim 15 in which said valve lifter engages said valve stem to impart rotation to said valve substantially only during the portion of the cycle of rotation of said cam in which said head portion of said valve is not seated on said valve seat.

18. The combination defined in claim 15 in which said engine body is provided with a hollow spring chamber, said first and said second bores in said engine body communicating with said spring chamber, said spring means being positioned in said spring chamber.

19. In combination, a cylinder block for a reciprocating internal combustion engine, a fluid passage in said cylinder block, said fluid passage terminating in an opening bounded by a valve seat, a reciprocably movable valve movable relative to said valve seat from a closed position in which said opening of said fluid passage is closed to an open position in which said opening of said fluid passage is open, spring means normally biasing said valve to a closed position, said valve comprising a head portion adapted to seat on said valve seat and a stem portion, a first bore in said cylinder block, a first guide bushing in said first bore, a valve stem guide bore in said first bushing concentric with the inner diameter of said first bushing, a second bore in said cylinder block lying on a common axis with and in axial alignment with said first bore, a second guide bushing in said second bore, a valve lifter including a valve lifter stem adapted to engage and move said valve to open position, a rotatable cam mounted on a cam shaft and adapted to engage said valve lifter during the cycle of rotation of said cam whereby to cause said valve lifter to move said valve to open position, the central plane of said cam as measured in the lengthwise dimension of the cam shaft on which said cam is mounted being offset relative to the axis of said valve lifter stem whereby rotation of said cam imparts rotation to said valve lifter, a bore in said second guide bushing for receiving and guiding the movement of said valve lifter stem, said bore in said second guide bushing being eccentric relative to said common axis, whereby the axis of said valve lifter stem is eccentric relative to the axis of said valve stem, said valve lifter being engageable with said stem portion of said valve during the cycle of rotation of said cam whereby to impart rotation to said valve relative to said valve seat.

20. In combination, an engine body for a reciprocating internal combustion engine, a fluid passage in said engine body, said fluid passage terminating in an opening bounded by a valve seat, a reciprocably movable valve movable relative to said valve seat from a closed position in which said opening of said fluid passage is closed to an open position in which said opening of said fluid passage is open, spring means normally biasing said valve to a closed position, said valve comprising a head portion adapted to seat on said valve seat and a stem portion, a first bore in said engine body, a first guide bushing in said first bore, a valve stem guide bore in said first bushing concentric with the inner diameter of said first bushing, a second bore in said engine body lying on a common axis with and in axial alignment with said first bore, a second guide bushing in said second bore, a valve lifter including a valve lifter stem adapted to engage and move said valve to open position, a rotatable cam mounted on a cam shaft and adapted to engage said valve lifter during the cycle of rotation of said cam whereby to cause said valve lifter to move said valve to open position, the central plane of said cam as measured in the lengthwise dimension of the cam shaft on which said cam is mounted being offset relative to the axis of said valve lifter stem whereby rotation of said cam imparts rotation to said valve lifter, a bore in said second guide bushing for receiving and guiding the movement of said valve lifter stem, said bore in said second guide bushing being eccentric relative to said common axis, whereby the axis of said valve lifter stem is eccentric relative to the axis of said valve stem, said valve lifter being engageable with said stem portion of said valve during the cycle of rotation of said cam whereby to impart rotation to said valve relative to said valve seat.

21. In combination, a cylinder block for a reciprocating internal combustion engine, a fluid passage in said cylinder block, said fluid passage terminating in an opening bounded by a valve seat, a reciprocably movable valve movable relative to said valve seat from a closed position in which said opening of said fluid passage is closed to an open position in which said opening of said fluid passage is open, spring means normally biasing said valve to a closed position, said valve comprising a head portion adapted to seat on said valve seat and a stem portion, a first bore in said cylinder block, said first bore being adapted to guide said valve stem, a second bore in said cylinder block lying on a common axis with and in axial alignment with said first bore, a guide bushing in said second bore, a valve lifter including a valve lifter stem adapted to engage and move said valve to open position, a rotatable cam mounted on a cam shaft and adapted to engage said valve lifter during the cycle of rotation of said cam whereby to cause said valve lifter to move said valve to open position, the central plane of said cam as measured in the lengthwise dimension of the cam shaft on which said cam is mounted being offset relative to the axis of said valve lifter stem whereby rotation of said cam imparts rotation to said valve lifter, a bore in said guide bushing for receiving and guiding the movement of said valve lifter stem, said bore in said guide bushing being eccentric relative to said common axis, whereby the axis of said valve lifter stem is eccentric relative to the axis of said valve stem, said valve lifter being engageable with said stem portion of said valve during the cycle of rotation of said cam whereby to impart rotation to said valve relative to said valve seat.

22. In combination, an engine body for a reciprocating internal combustion engine, a fluid passage in said engine body, said fluid passage terminating in an opening bounded by a valve seat, a reciprocably movable valve movable relative to said valve seat from a closed position in which said opening of said fluid passage is closed to an open position in which said opening of said fluid passage is open, spring means normally biasing said valve to a closed position, said valve comprising a head portion adapted to seat on said valve seat and a stem portion, a first bore in said engine body, said first bore being adapted to guide said valve stem, a second bore in said engine body lying on a common axis with and in axial alignment with said first bore, a guide bushing in said second bore, a valve lifter including a valve lifter stem adapted to engage and move said valve to open position, a rotatable cam mounted on a cam shaft and adapted to engage said valve lifter during the cycle of rotation of said cam whereby to cause said valve lifter to move said valve to open position, the central plane of said cam as measured in the lengthwise dimension of the cam shaft on which said cam is mounted being offset relative to the axis of said valve lifter stem whereby rotation of said cam imparts rotation to said valve lifter, a bore in said guide bushing for receiving and guiding the movement of said valve lifter stem, said bore in said guide bushing being eccentric relative to said common axis, whereby the axis of said valve lifter stem is eccentric relative to the axis of said valve stem, said valve lifter being engageable with said stem portion of said valve during the cycle of rotation of said cam whereby to impart rotation to said valve relative to said valve seat.

* * * * *